US010180067B2

(12) United States Patent
Beattie et al.

(10) Patent No.: US 10,180,067 B2
(45) Date of Patent: Jan. 15, 2019

(54) MATE FACE COOLING HOLES FOR GAS TURBINE ENGINE COMPONENT

(75) Inventors: Jeffrey S. Beattie, South Glastonbury, CT (US); Scott D. Lewis, Vernon, CT (US); Mark F. Zelesky, Bolton, CT (US); Ricardo Trindade, Coventry, CT (US); Bret M. Teller, Meriden, CT (US); Jeffrey Michael Jacques, East Hartford, CT (US); Brandon M. Rapp, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1877 days.

(21) Appl. No.: 13/485,588

(22) Filed: May 31, 2012

(65) Prior Publication Data

US 2014/0321961 A1 Oct. 30, 2014

(51) Int. Cl.

*F01D 5/08* (2006.01)
*F01D 25/12* (2006.01)
*F01D 5/18* (2006.01)

(52) U.S. Cl.

CPC ..... *F01D 5/085* (2013.01); *F01D 5/081* (2013.01); *F01D 5/187* (2013.01); *F01D 25/12* (2013.01); *F05D 2240/81* (2013.01); *F05D 2260/202* (2013.01); *F05D 2260/203* (2013.01)

(58) Field of Classification Search

CPC ... F01D 5/08; F01D 5/081; F01D 5/18; F05D 2240/81; F05D 2260/203

See application file for complete search history.

(56) References Cited

U.S. PATENT DOCUMENTS

| | | | | |
|---|---|---|---|---|
| 5,382,135 | A | 1/1995 | Green | |
| 6,190,128 | B1 | 2/2001 | Fukuno et al. | |
| 6,190,130 | B1 | 2/2001 | Fukue et al. | |
| 6,196,799 | B1 | 3/2001 | Fukue et al. | |
| 6,210,111 | B1 | 4/2001 | Liang | |
| 6,290,464 | B1 * | 9/2001 | Negulescu et al. | 416/97 R |
| 6,428,270 | B1 * | 8/2002 | Leone et al. | 415/115 |
| 6,431,833 | B2 | 8/2002 | Jones | |
| 6,481,967 | B2 | 11/2002 | Tomita et al. | |
| 6,572,335 | B2 | 6/2003 | Kuwabara et al. | |
| 6,644,920 | B2 | 11/2003 | Beeck et al. | |

(Continued)

FOREIGN PATENT DOCUMENTS

WO 2012028424 3/2012

OTHER PUBLICATIONS

International Search Report and Written Opinion, dated Aug. 27, 2013.

*Primary Examiner* — Ninh H. Nguyen
*Assistant Examiner* — Jason G Davis
(74) *Attorney, Agent, or Firm* — Kinney & Lange, P.A.

(57) ABSTRACT

A gas turbine engine component comprises a shroud, a U-channel, an internal cooling air passage and a U-channel cooling hole. The shroud comprises a forward face, an aft face, a first side face and a second side face. The U-channel is disposed in the aft face of the shroud. A gas path surface connects the forward face, aft face, first side face and second side face. A cooled surface connects the forward face, aft face, first side face and second side face opposite the gas path face. The internal cooling air passage extends through the shroud. The U-channel cooling hole extends into the first side face of the shroud adjacent the U-channel to intersect the internal cooling passage.

19 Claims, 5 Drawing Sheets

(56) References Cited

U.S. PATENT DOCUMENTS

| | | | | |
|---|---|---|---|---|
| 6,761,536 | B1 * | 7/2004 | Bash et al. | 416/193 A |
| 6,887,033 | B1 | 5/2005 | Phillips et al. | |
| 6,945,749 | B2 | 9/2005 | DeCardenas | |
| 7,186,089 | B2 | 3/2007 | Liang | |
| 7,309,212 | B2 | 12/2007 | Itzel et al. | |
| 7,416,391 | B2 | 8/2008 | Veltre et al. | |
| 7,431,564 | B2 | 10/2008 | Newman | |
| 7,467,922 | B2 | 12/2008 | Beeck et al. | |
| 7,600,972 | B2 | 10/2009 | Benjamin et al. | |
| 7,695,247 | B1 | 4/2010 | Liang | |
| 8,641,377 | B1 * | 2/2014 | Liang | 416/96 R |
| 2006/0269409 | A1 | 11/2006 | Torii et al. | |
| 2007/0201979 | A1 * | 8/2007 | Veltre et al. | 416/97 R |
| 2007/0253816 | A1 | 11/2007 | Walz et al. | |
| 2007/0269313 | A1 | 11/2007 | Nadvit et al. | |
| 2009/0269184 | A1 | 10/2009 | Spangler et al. | |
| 2010/0322767 | A1 | 12/2010 | Nadvit et al. | |
| 2010/0329888 | A1 | 12/2010 | Nadvit et al. | |
| 2011/0067409 | A1 * | 3/2011 | Beeck | 60/772 |
| 2011/0229344 | A1 | 9/2011 | Johnson | |
| 2012/0082564 | A1 | 4/2012 | Ellis et al. | |
| 2012/0251331 | A1 * | 10/2012 | Dietrich et al. | 416/97 R |

* cited by examiner

MATE FACE COOLING HOLES FOR GAS TURBINE ENGINE COMPONENT

BACKGROUND

The present invention relates generally to cooling of gas turbine engine components and more specifically to cooling of adjoining mate faces in cooled gas turbine engine components, such as shrouds and platforms.

Gas turbine engines operate by passing a volume of high energy gases through a plurality of stages of vanes and blades, each having an airfoil, in order to drive turbines to produce rotational shaft power. The shaft power is used to drive a compressor to provide compressed air to a combustion process to generate the high energy gases. Additionally, the shaft power is used to drive a generator for producing electricity, or to drive a fan for producing high momentum gases for producing thrust. In order to produce gases having sufficient energy to drive the compressor, generator and fan, it is necessary to combust the fuel at elevated temperatures and to compress the air to elevated pressures, which also increases its temperature. Thus, the vanes and blades are subjected to extremely high temperatures, often times exceeding the melting point of the alloys comprising the airfoils. High pressure turbine blades are subject to particularly high temperatures.

In order to maintain gas turbine engine turbine blades at temperatures below their melting point, it is necessary to, among other things, cool the blades with a supply of relatively cooler air, typically bled from the compressor. The cooling air is directed into the blade to provide convective cooling internally and film cooling externally. For example, cooling air is passed into interior cooling channels of the airfoil to remove heat from the alloy, and subsequently discharged through cooling holes to pass over the outer surface of the airfoil to prevent the hot gases from contacting the vane or blade directly. Various cooling air channels and hole patterns have been developed to ensure sufficient cooling of various portions of the turbine blade.

A typical turbine blade is connected at its inner diameter ends to a rotor, which is connected to a shaft that rotates within the engine as the blades interact with the gas flow. The rotor typically comprises a disk having a plurality of axial retention slots that receive mating root portions of the blades to prevent radial dislodgment. Blades typically also include integral inner diameter platforms that prevent the high temperature gases from escaping through the radial retention slots. It is desirable to further provide targeted cooling to the platforms to cool the surfaces between adjacent platforms. There is a continuing need to improve cooling of turbine blade platforms to increase the temperature to which the blade can be exposed, thereby increasing the overall efficiency of the gas turbine engine.

SUMMARY

The present invention is directed toward a gas turbine engine component, such as a shroud, platform or blade outer air seal. The gas turbine engine component comprises a shroud, a U-channel, an internal cooling air passage and a U-channel cooling hole. The shroud comprises a forward face, an aft face, a first side face and a second side face. The U-channel is disposed in the aft face of the shroud. A gas path surface connects the forward face, aft face, first side face and second side face. A cooled surface connects the forward face, aft face, first side face and second side face opposite the gas path face. The internal cooling air passage extends through the shroud. The U-channel cooling hole extends into the first side face of the shroud adjacent the U-channel to intersect the internal cooling passage.

DETAILED DESCRIPTION

Figure 1:
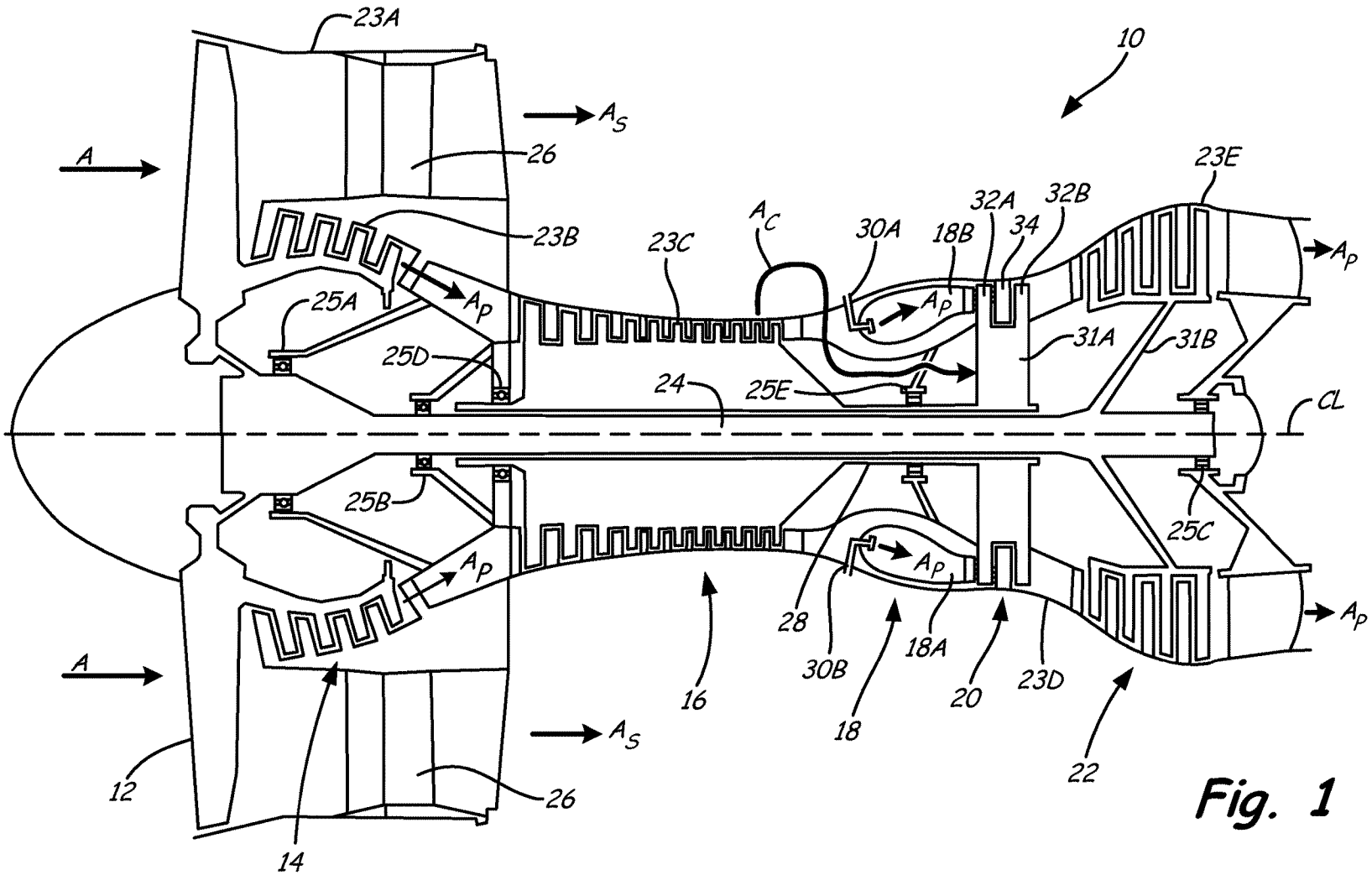
FIG. 1 shows a gas turbine engine including a high pressure turbine section in which the U-channel cooling holes of the present invention are used.

FIG. 1 shows gas turbine engine 10, in which the platform mate face cooling holes of the present invention may be used. Gas turbine engine 10 comprises a dual-spool turbofan engine having fan 12, low pressure compressor (LPC) 14, high pressure compressor (HPC) 16, combustor section 18, high pressure turbine (HPT) 20 and low pressure turbine (LPT) 22, which are each concentrically disposed around longitudinal engine centerline CL. Fan 12 is enclosed at its outer diameter within fan case 23A. Likewise, the other engine components are correspondingly enclosed at their outer diameters within various engine casings, including LPC case 23B, HPC case 23C, HPT case 23D and LPT case 23E such that an air flow path is formed around centerline CL. Although depicted as a dual-spool turbofan engine in the disclosed non-limiting embodiment, it should be understood that the concepts described herein are not limited to use with turbofans as the teachings may be applied to other types of turbine engine, such as three-spool turbine engines and geared fan turbine engines.

Inlet air A enters engine 10 and it is divided into streams of primary air $A_P$ and secondary air $A_S$ after it passes through fan 12. Fan 12 is rotated by low pressure turbine 22 through shaft 24 to accelerate secondary air $A_S$ (also known as bypass air) through exit guide vanes 26, thereby producing a major portion of the thrust output of engine 10. Shaft 24 is supported within engine 10 at ball bearing 25A, roller bearing 25B and roller bearing 25C. Low Pressure Compressor (LPC) 14 is also driven by shaft 24. Primary air $A_P$ (also known as gas path air) is directed first into LPC 14 and then into high pressure compressor (HPC) 16. LPC 14 and HPC 16 work together to incrementally step-up the pressure of primary air $A_P$. HPC 16 is rotated by HPT 20 through shaft 28 to provide compressed air to combustor section 18, which includes inlet guide vanes 29. Shaft 28 is supported within engine 10 at ball bearing 25D and roller bearing 25E. The compressed air is delivered to combustors 18A and 18B, along with fuel through injectors 30A and 30B, such that a combustion process can be carried out to produce the high energy gases necessary to turn turbines 20 and 22, as is known in the art. Primary air $A_P$ continues through gas turbine engine 10 whereby it is typically passed through an exhaust nozzle to further produce thrust.

HPT 20 and LPT 22 each include a circumferential array of blades extending radially from discs 31A and 31B connected to shafts 28 and 24, respectively. Similarly, HPT 20 and LPT 22 each include a circumferential array of vanes extending radially from HPT case 23D and LPT case 23E, respectively. Specifically, HPT 20 includes blades 32A and 32B and vanes 34. Blades 32A and 32B include internal channels or passages into which compressed cooling air $A_C$ air from, for example, HPC 16 is directed to provide cooling relative to the hot combustion gasses. Blade 32A of the present invention includes a platform having mate face cooling holes for cooling a trailing edge U-channel. Although described with reference to blade 32A, the cooling holes of the present invention may be used in other gas turbine engine components having a U-channel, such as turbine vanes, shrouds and blade outer air seals.

Figure 2:
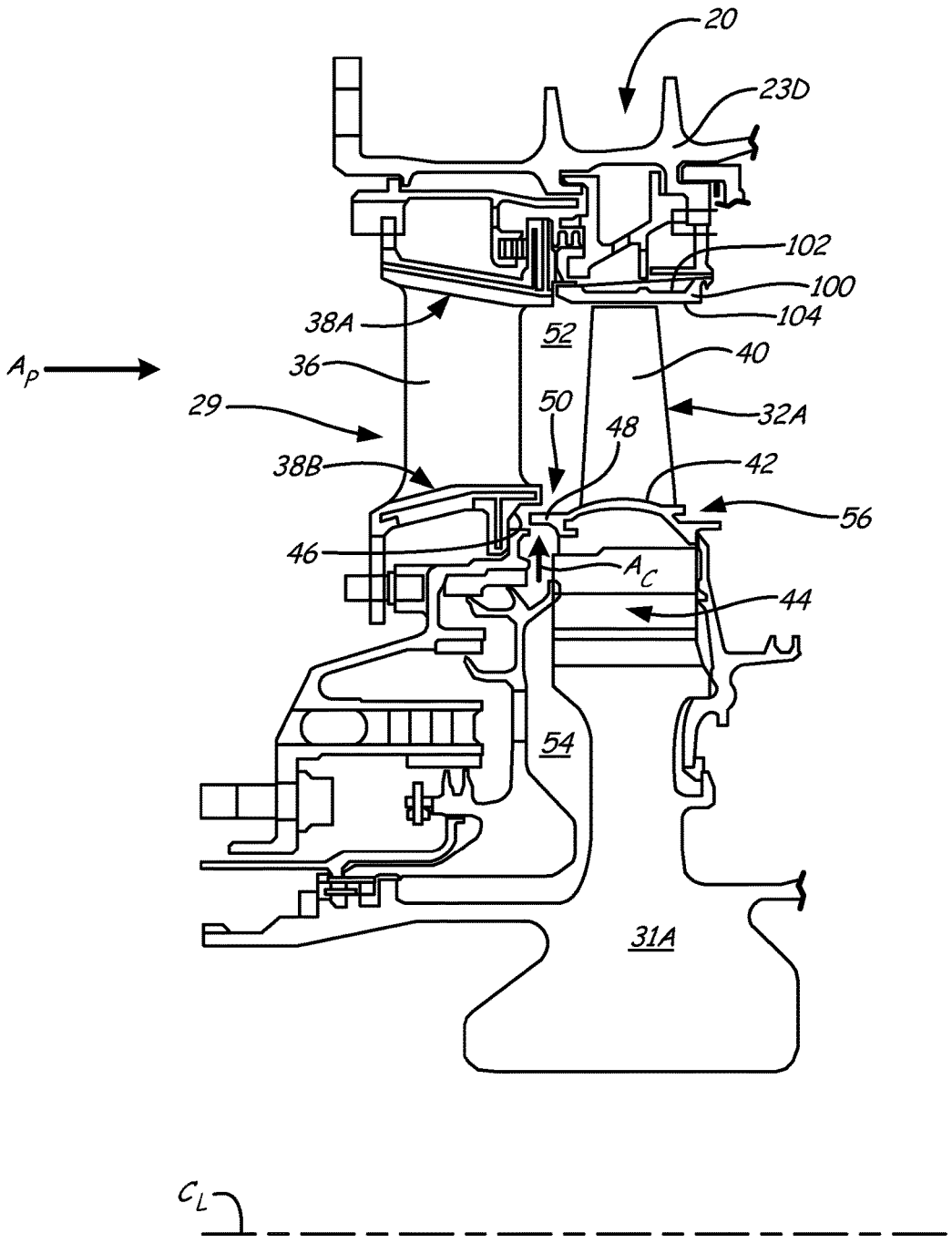
FIG. 2 is a schematic view of the high pressure turbine section of FIG. 1 showing a high pressure turbine blade having a platform with a U-channel.

FIG. 2 shows a schematic view of high pressure turbine 20 of gas turbine engine 10 of FIG. 1 having inlet guide vane 29 and turbine blade 32A disposed within engine case 23D. Inlet guide vane 29 comprises airfoil 36, which is suspended from turbine case 23D at its outer diameter end at shroud 38A and is retained at its inner diameter end by shroud 38B. Turbine blade 32A comprises airfoil 40, which extends radially outward from platform 42. Airfoil 40 and platform 42 are coupled to rotor disk 31A through firtree/slot connection 44. Turbine blade 32A and rotor disk 31A rotate about engine centerline CL. Shroud 38B includes cutback 46 and platform 42 includes fin 48, which mate to form labyrinth seal 50 separating gas path 52 from cavity 54. Platform 42 also includes U-channel 56, which is configured to receive a forward-extending fin from second stage vane 34 (FIG. 1) to form an additional labyrinth seal.

Airfoil 36 and airfoil 40 extend from their respective inner diameter supports toward engine case 23D, across gas path 52. Hot combustion gases of primary air $A_P$ are generated within combustor 18 (FIG. 1) upstream of turbine section 20 and flow through gas path 52. Airfoil 36 of inlet guide vane 29 straightens the flow of primary air $A_P$ to improve incidence on airfoil 40 of turbine blade 32A. As such, airfoil 40 is better able to extract energy from primary air $A_P$. Specifically, primary air $A_P$ impacts airfoil 40 to cause rotation of turbine blade 32A and rotor disk 31A about centerline CL. Due to the elevated temperatures of primary air $A_P$, cooling air $A_C$ is provided to the interior of shroud 38B and platform 42 to purge hot gas from cavity 54. For example, cooling air $A_C$, which is relatively cooler than primary air $A_P$ may be routed from high pressure compressor 16 (FIG. 1) driven by high pressure turbine 20. Likewise, airfoils 36 and 40 include internal cooling passages (FIGS. 4 & 5) to receive portions of cooling air $A_C$.

The cooling air $A_C$ directed into blade 32A is passed into airfoil 40 to cool exterior surfaces of airfoil 40, which includes film cooling holes as is known in the art. In the present invention, a portion of cooling air $A_C$ is directed to side faces of platform 42 that abut or adjoin mating faces of adjacent platforms. This cooling air provides direct impingement cooling of the platform mate faces, but also provides film and impingement cooling to U-channel 56, as is discussed with reference to FIGS. 3-5.

Figure 3:
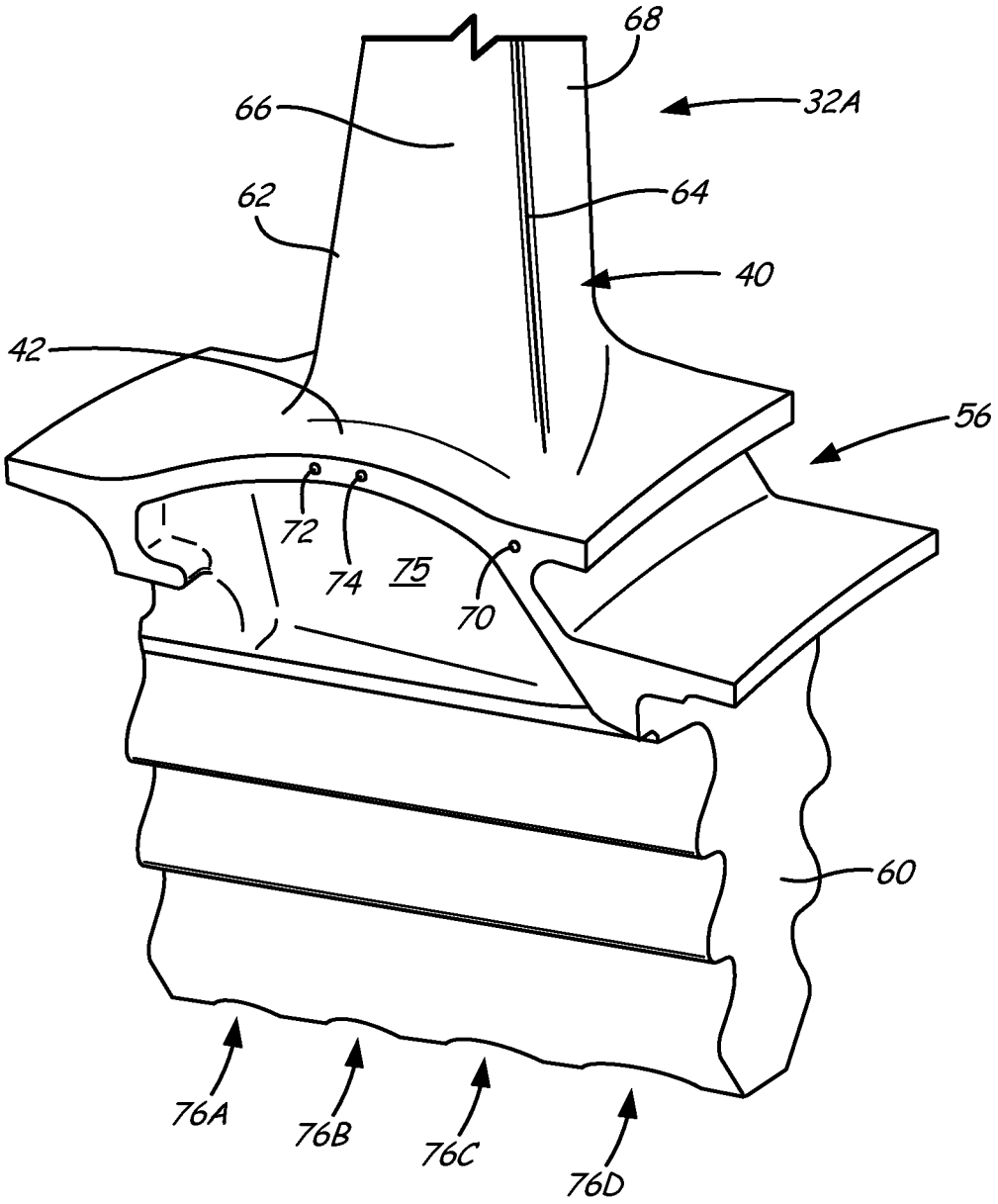
FIG. 3 is a partial perspective view of the high pressure turbine blade of FIG. 2 showing mate face cooling holes on a pressure side of the platform upstream of the U-channel.

FIG. 3 is a partial perspective view of high pressure turbine blade 32A of FIG. 2 showing mate face cooling holes 70, 72 and 74 on platform 42 upstream of U-channel 56. Blade 32A includes airfoil 40, platform 42 and root 60. A span of airfoil 40 extends radially from platform 42 to a blade tip (FIG. 5). Airfoil 40 extends generally axially along platform 42 from leading edge 62 to trailing edge 64 across a chord length. Airfoil 40 also includes pressure side 66 and suction side 68, which are typically concavely and convexly contoured, respectively, to from an airfoil shape as is known in the art. Root 60 comprises a dovetail or fir tree configuration for engaging disc 31A (FIG. 1), as is known in the art. Root 60 also includes shank 75, which connects the engagement portion of root 60 with radially inward, non-gas path, surfaces of platform 42. Platform 42 shrouds the outer radial extent of root 60 to separate gas path 52 (FIG. 2) of HPT 20 from the interior of engine 10 (FIG. 1). Airfoil 40 extends from platform 42 to engage gas path 52. Airfoil 40 may include various patterns and arrays of cooling holes as are known in the art. Platform 42 includes U-channel cooling hole 70, forward supplemental cooling hole 72 and second supplemental cooling hole 74. Airfoil 40 includes internal cooling passages (FIGS. 4 & 5) that extend from inlets 76A-76D to the tip of airfoil 40. Cooling air $A_C$ introduced into inlets 76A-76D is discharged from various cooling holes in airfoil 40, U-channel cooling hole 70 and supplemental cooling holes 72 and 74. U-channel cooling hole 70 is positioned to provide direct impingement cooling of a mate face of an adjacent turbine blade. Cooling air $A_C$ emanating from U-channel cooling hole 70 also forms a shroud of film cooling air $A_C$ along platform 42 that inhibits entry of primary air $A_P$ (FIG. 2) into U-channel 56 at the mate faces. Thereafter, cooling air $A_C$ discharged from hole 70 enters U-channel 56 to directly cool portions of platform 42 that form U-channel 56. Cooling air $A_C$ from holes 72 and 74 flows downstream to augment cooling air provided by U-channel cooling hole 70.

Figure 4:
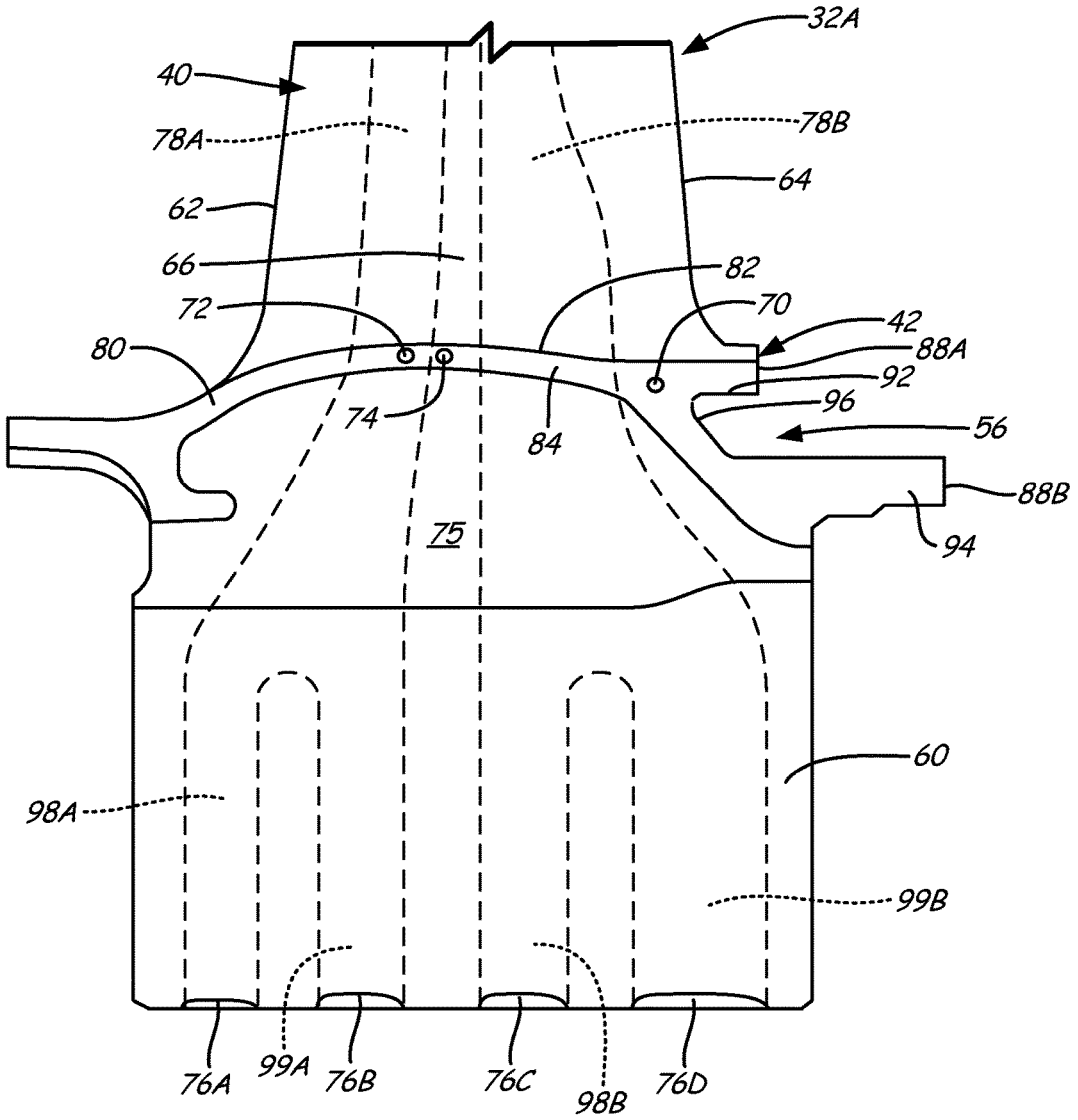
FIG. 4 is a partial side view of the high pressure turbine blade of FIG. 3 showing the location of the mate face cooling holes with respect to internal cooling passages.
Figure 5:
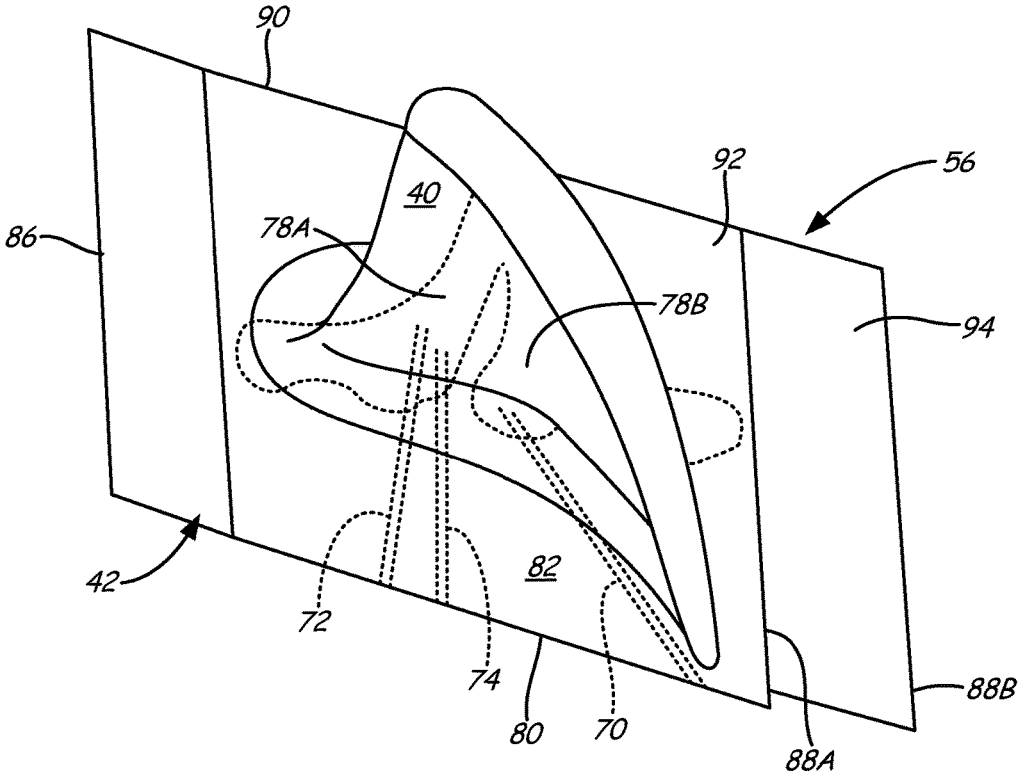
FIG. 5 is a top view of the high pressure turbine blade of FIG. 3 showing the orientation of the mate face cooling holes with respect to the internal cooling passages.

FIG. 4 is a partial side view of high pressure turbine blade 32A of FIG. 3 showing the location of internal cooling passages 78A and 78B. FIG. 5 is a top view of high pressure turbine blade 32A of FIG. 3 showing platform cooling holes 70, 72 and 74 extending from pressure side mate face 80 to internal cooling passages 78A and 78B. FIG. 4 and FIG. 5 are discussed concurrently. Platform 42 includes gas path surface 82, inner surface 84, leading edge face 86, trailing edge faces 88A and 88B, pressure side mate face 80 and suction side mate face 90. U-channel 56 includes first flange 92, second flange 94 and base 96. Cooling passage 78A includes feed channels 98A and 99A. Cooling passage 78B includes feed channels 98B and 99B.

Turbine blade 32A is positioned in gas path 52 such that a flow of primary air $A_P$ flows across airfoil 40 and over gas path surface 82 of platform 42. Cooling air $A_C$ travels underneath platform 42 against inner surface 84, and through blade 32A within passages 78A and 78B. In one embodiment, second flange 94 comprises an angel wing seal that cooperates with a seal fin of an adjacent vane. A fin of stator vane 34 (FIG. 1) extends into U-channel 56 between first flange 92 and second flange 94 to prevent primary air $A_P$ from passing into cavity 54 (FIG. 2). First flange 92 includes a proximate end that connects to platform 42 out to a distal end having trailing edge face 88A. First flange 92 forms an extension of gas path surface 82 that extends beneath trailing edge 64 of airfoil 40. Base 96 of U-channel 56 curves inward from the proximate end of first flange 92 to join with a proximate end of second flange 94. A distal end of second flange 94 extends out to trailing edge face 88B, which is positioned further downstream than the distal end of first flange 92. Thus, first flange 92 and second flange 94 comprise generally axially downstream extending portions of platform 42.

The labyrinth seal formed by U-channel 56 prevents the ingestion of primary air $A_P$ into cavity 54 (FIG. 2). Additionally, the pressure of cooling air $A_C$ within cavity 54 inhibits ingestion of primary air $A_P$. However, depending on the operating pressures of engine 10 and other factors, it is sometimes possible for primary air $A_P$ to leak into U-channel 56. Cooling air $A_C$ and primary air $A_P$ mix within U-channel 56, typically in proportions that maintain platform 42 at sufficiently cool temperatures. In order to ensure that temperatures within U-channel 56 stay at cool temperatures, pressure side mate face 80 is provided with cooling holes, 70, 72 and 74 to provide an additional cooling mechanism to U-channel 56.

Cooling air for U-channel cooling hole 70 is provided from passage 78B. Cooling air exiting U-channel cooling hole 70 directly impacts a platform 42 of an adjacent turbine blade, thereby providing direct impingement cooling. Cooling hole 70 is positioned so that the cooling air impinges on portions of platform 42 forming U-channel 56. Specifically, U-channel cooling hole 70 is positioned at the juncture, or apex, of first flange 92, second flange 94 and base 96, beneath trailing edge 64 of airfoil 40. Thus, from hole 70, the cooling hole can disperse along mate face 80. Furthermore, the cooling air fills the gap between adjacent platforms 42 with a shroud of cooling air that shrouds over the top of U-channel 56. Thus, a film of cooling air forms an air dam that blocks ingestion of primary air $A_P$ into U-channel 56. Additionally, the cooling air ultimately curls around base 96 to enter into U-channel 56 to further dilute any primary air $A_P$ that may have entered therein.

Cooling air from U-channel cooling hole 70 is supplemented with cooling air from forward, augmenting cooling holes 72 and 74. Cooling air for cooling holes 72 and 74 is provided from passage 78A. Cooling air from holes 72 and 74 directly impacts a platform 42 of an adjacent turbine blade, thereby providing direct impingement cooling. Cooling air from holes 72 and 74 also fortifies cooling air from hole 70 such that a stronger, more forceful combined flow of cooling air is formed to more effectively block primary air $A_P$. Furthermore, the combined flow is cooler and better able to dilute primary air that has entered U-channel 56.

As indicated in FIG. 4, cooling holes 70, 72 and 74 extend into platform 42 perpendicular to mate face 80 to intersect passages 78A and 78B. As shown in FIG. 5, cooling holes extend straight into mate face 80 without any curvature. Such a configuration facilitates easy manufacture. In other embodiments, however, holes 70, 72 and 74 may have other orientations. In the shown embodiment, cooling hole 70 has a diameter of 0.018 inches (~0.4572 mm), and cooling holes 72 and 74 have a diameter of 0.014 inches (~0.3556), although other hole sizes may be used. As shown in FIG. 5, cooling hole extends from passage 78B to mate face 80 with a downstream vector component so as to have an outlet positioned in the vicinity of U-channel 56. Cooling hole 72 extends from passage 78A to mate face 80 with a slight upstream vector component, and cooling hole 74 extends from passage 78A to mate face 80 generally perpendicular to the upstream and downstream direction. In other embodiments, holes 70, 72 and 74 may have other vector downstream or upstream vector orientations.

The U-channel cooling hole scheme of the present invention has been described with respect to a platform of a turbine blade, but may also be used in other gas turbine engine components such as turbine vanes, compressor blades, compressor vanes, shrouds and blade outer air seals. For example, cooling holes 70, 72 and 74 may be positioned in mate faces of shroud 38B of vane 29, or in blade outer air seal (BOAS) 100 (FIG. 2). BOAS 100, shroud 38B and platform 42 each comprise a shroud-like component having a forward face, an aft face and two side faces. The forward, aft and side faces are bound by a gas path surface that faces gas path 52, and a cooled surface that faces away from gas path 52 to a cooled portion of engine 10 such as cavity 54 or plenum 102 radially outward of BOAS 100. The cooled surface of BOAS 100 forms plenum 102, into which cooling air AC from HPC 16 is directed to cool BOAS 100. Gas path surface 104 of BOAS 100 comprises, in one embodiment, an abradable material that seals against airfoil 40 of blade 32A.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A turbine blade comprises: an airfoil, a platform surrounding a base of the airfoil, a U-channel disposed in an aft face of the platform, a root extending from the platform opposite the airfoil, an internal cooling passage extending through the turbine blade, and a U-channel cooling hole extending from the internal cooling passage to a mate face of the platform upstream of the U-channel.

The turbine blade of the preceding paragraph can optionally include, additionally and/or alternatively, any one or more of the following features, configurations and/or additional components:

the airfoil comprises: a leading edge, a trailing edge, a pressure side extending between the leading edge and the trailing edge with a predominantly concave curvature, a suction side extending between the leading edge and the trailing edge with a predominantly convex curvature, and a span extending radially from an inner diameter base to a outer diameter tip, wherein the U-channel cooling hole extends into a pressure side mate face of the platform;

the U-channel cooling hole is positioned radially inward of a trailing edge of the airfoil;

the platform comprises: the aft face, a forward face opposite the aft face, an upper surface defining an end wall from which the airfoil extends, a lower surface opposite the upper surface and from which the root extends, a first side face, and a second side face comprising the mate face into which the U-channel cooling hole extends;

the U-channel comprises: a first flange comprising: a first proximate end extending from the platform, and a first distal end opposite the first proximate end; a base extending radially inward from the first proximate end; and a second flange comprising: a second proximate end extending from the base, and a second distal end opposite the second proximate end;

the second flange comprises an angel wing seal and is longer than the first flange;

the base is arcuate;

the U-channel cooling hole is positioned at an apex between the base, the first flange and the second flange;

the internal cooling channel passage comprises: forward and aft channels extending through the airfoil, wherein the U-channel cooling hole extends to the aft channel;

the internal cooling channel further comprises: first and second feed channels extending through the root and joining to the forward channel, and third and fourth feed channels extending through the root and joining to the aft channel;

a pair of forward cooling holes extending into the side face of the platform upstream of the U-channel cooling hole;

the U-channel cooling hole extends straight between an inlet and an outlet; and the U-channel cooling hole extends from the internal cooling passage to the side face of the platform with a downstream vector component.

A method for cooling a U-channel in a gas turbine engine shroud comprises: flowing cooling air through an internal cooling passage of the turbine engine shroud; directing a portion of the cooling air through a U-channel cooling hole extending from the internal cooling passage to a mate face of the gas turbine engine shroud upstream of the U-channel; and passing the portion of the cooling air into the U-channel.

The method of the preceding paragraph can optionally include, additionally and/or alternatively, any one or more of the following features and/or additional steps:

the step of forming an air dam above the U-channel with the portion of the cooling air to prevent hot combustion gas from entering the U-channel;

the step of augmenting the portion of the cooling air passing through the U-channel cooling hole with additional cooling air from an additional cooling hole extending from the internal cooling passage to the mate face upstream of the U-channel cooling hole; and the step of forming a layer of film cooling air along the mate face with the portion of the cooling air.

A gas turbine engine component comprises: a shroud comprising a forward face, an aft face, a first side face and a second side face; a U-channel disposed in the aft face of the shroud; a gas path surface connecting the forward face, aft face, first side face and second side face; a cooled surface connecting the forward face, aft face, first side face and second side face opposite the gas path face; an internal cooling air passage extending through the shroud; and a U-channel cooling hole extending into the first side face of the shroud adjacent the U-channel to intersect the internal cooling passage.

The gas turbine engine component of the preceding paragraph can optionally include, additionally and/or alternatively, any one or more of the following features, configurations and/or additional components:

a first flange comprising: a first proximate end extending from the aft face of the platform, and a first distal end opposite the first proximate end; a base extending radially inward from the first proximate end; and a second flange comprising: a second proximate end extending from the base, and a second distal end opposite the second proximate end;

a pair of forward cooling holes extending into the first side face of the shroud upstream of the U-channel cooling hole; and an airfoil extending radially outward from the gas path surface, the airfoil having a leading edge, a trailing edge, a pressure side, a suction side, an outer diameter end and an inner diameter end, and a root extending radially inward from the cooled surface.

The invention claimed is:

1. A turbine blade comprising:

an airfoil;

a platform surrounding a base of the airfoil;

a U-channel disposed in an aft face of the platform;

a root extending from the platform opposite the airfoil;

an internal cooling passage extending through the turbine blade;

a U-channel cooling hole extending in a downstream direction from the internal cooling passage to a mate face of the platform upstream of the U-channel;

a forward cooling passage extending through the turbine blade upstream from the internal cooling passage; and a first auxiliary cooling hole extending in an upstream direction from the forward cooling passage to the mate face of the platform, wherein the first auxiliary cooling hole is upstream from the U-channel cooling hole;

wherein the U-channel cooling hole and the first auxiliary cooling hole are configured to impinge cooling air onto an adjacent platform face and to provide film cooling along radially inner and outer faces of the U-channel with at least a portion of the cooling air after the portion of the cooling air has impinged on the adjacent platform face.

2. The turbine blade of claim 1 wherein the airfoil comprises:

a leading edge;

a trailing edge;

a pressure side extending between the leading edge and the trailing edge with a predominantly concave curvature;

a suction side extending between the leading edge and the trailing edge with a predominantly convex curvature; and a span extending radially from an inner diameter base to an outer diameter tip;

wherein the U-channel cooling hole extends into a pressure side mate face of the platform.

3. The turbine blade of claim 1 wherein the U-channel cooling hole is positioned radially inward of a trailing edge of the airfoil.

4. The turbine blade of claim 1 wherein the platform comprises:

the aft face;

a forward face opposite the aft face;

an upper surface defining an end wall from which the airfoil extends;

a lower surface opposite the upper surface and from which the root extends;

a first side face; and a second side face comprising the mate face into which the U-channel cooling hole extends.

5. The turbine blade of claim 1 wherein the U-channel comprises:

a first flange comprising:

a first proximate end extending from the platform; and a first distal end opposite the first proximate end;

a base extending radially inward from the first proximate end; and a second flange comprising:

a second proximate end extending from the base; and a second distal end opposite the second proximate end.

6. The turbine blade of claim 5 wherein the second flange comprises an angel wing seal and is longer than the first flange.

7. The turbine blade of claim 5 wherein the base is arcuate.

8. The turbine blade of claim 5 wherein the U-channel cooling hole is positioned at an apex between the base, the first flange and the second flange.

9. The turbine blade of claim 1 wherein the internal cooling channel further comprises:

first and second feed channels extending through the root and joining to the forward cooling passage; and third and fourth feed channels extending through the root and joining to the internal cooling passage.

10. The turbine blade of claim 1 wherein the U-channel cooling hole extends straight between an inlet and an outlet.

11. The turbine blade of claim 1 wherein the U-channel cooling hole extends from the internal cooling passage to the mate face of the platform with a downstream vector component.

12. The turbine blade of claim 1 and further comprising:

a second auxiliary cooling hole extending from the forward cooling passage to the mate face, wherein the second auxiliary cooling hole is disposed between the first auxiliary cooling hole and the U-channel cooling hole.

13. A method for cooling a U-channel in a gas turbine engine shroud, the method comprising:

flowing cooling air through an internal cooling passage of the turbine engine shroud;

flowing cooling air through a forward cooling passage of the turbine engine shroud;

directing a first portion of the cooling air through a U-channel cooling hole extending in a downstream direction from the internal cooling passage to a mate face of the gas turbine engine shroud upstream of the U-channel so that the first portion of the cooling air impinges on an adjacent platform face;

directing a second portion of the cooling air through a first auxiliary cooling hole extending in an upstream direction from the forward cooling passage to the mate face;

passing the first portion of the cooling air into the U-channel to provide film cooling to the U-channel, wherein the auxiliary cooling hole is configured such that the second portion of the cooling air augments the film cooling of the first portion of the cooling air.

14. The method of claim 13 and further comprising:

forming an air dam above the U-channel with the first portion of the cooling air to prevent hot combustion gas from entering the U-channel.

15. The method of claim 13 and further including:

directing a third portion of the cooling air through a second auxiliary cooling hole extending from the forward cooling passage to the mate face.

16. A gas turbine engine component comprising:

a shroud comprising a forward face, an aft face, a first side face and a second side face;

a U-channel disposed in the aft face of the shroud;

a gas path surface connecting the forward face, aft face, first side face and second side face;

a cooled surface connecting the forward face, aft face, first side face and second side face opposite the gas path face;

an internal cooling air passage extending through the shroud; and a U-channel cooling hole extending in a downstream direction into the first side face of the shroud adjacent the U-channel to intersect the internal cooling passage;

a forward cooling passage extending through the shroud upstream from the internal cooling passage; and a first auxiliary cooling hole extending in an upstream direction from the forward cooling passage to the first side face, wherein the first auxiliary cooling hole is upstream from the U-channel cooling hole;

wherein the U-channel cooling hole has an outlet positioned at an apex of the U-channel such that cooling air discharging therefrom impinges onto an adjacent platform face and flows along radially inner and outer faces of the U-channel after impinging on the adjacent platform face.

17. The gas turbine engine component of claim 16 wherein the U-channel comprises:

a first flange comprising:

a first proximate end extending from the aft face of the platform; and a first distal end opposite the first proximate end;

a base extending radially inward from the first proximate end; and a second flange comprising:

a second proximate end extending from the base; and a second distal end opposite the second proximate end.

18. The gas turbine engine component of claim 16 wherein:

an airfoil extending radially outward from the gas path surface, the airfoil having a leading edge, a trailing edge, a pressure side, a suction side, an outer diameter end and an inner diameter end; and a root extending radially inward from the cooled surface.

19. The gas turbine engine of claim 16 and further comprising:

a second auxiliary cooling hole extending from the forward cooling passage to the first side face, wherein the second auxiliary cooling hole is disposed between the first auxiliary cooling hole and the U-channel cooling hole.

* * * * *